United States Patent [19]

Moen

[11] 3,955,482

[45] May 11, 1976

[54] TRAY FORMING AND WELDING MACHINE

[76] Inventor: Lenard E. Moen, 7914 Michigan, Whittier, Calif. 90602

[22] Filed: Aug. 13, 1974

[21] Appl. No.: 496,928

[52] U.S. Cl. ..... 93/51 R; 93/41

[51] Int. Cl.[2] ..... B31B 3/26; B31B 1/46

[58] Field of Search ..... 93/51 R, 51 HW, 41, 93/56 R, 49 R, 47, 36 R, DIG. 1

[56] References Cited

UNITED STATES PATENTS

| | | | |
|---|---|---|---|
| 2,843,027 | 7/1958 | Sevison | 93/45 |
| 2,997,928 | 8/1961 | Hoyrup | 93/51 R |
| 3,115,073 | 12/1963 | Kreimendahl | 93/51 R |
| 3,125,007 | 3/1964 | Jaroff et al. | 93/51 HW |
| 3,376,796 | 4/1968 | Gordon | 93/51 R |
| 3,421,416 | 1/1969 | Benzon-Petersen | 93/41 X |
| 3,451,317 | 6/1969 | Hakansson et al. | 93/51 HW |

*Primary Examiner*—James F. Coan
*Attorney, Agent, or Firm*—Frederick E. Mueller

[57] ABSTRACT

Preformed tray blanks, e.g., of an expanded foam thermoplastic material, are individually transported from a supply hopper into registration with a die cavity through which a mandrel forces the blank. In passing through the die, the blank is sequentially moved through sidewall-erecting, radiant heating, and corner tab folding stations by the extension stroke of the mandrel. A fluid power and control system moves the mandrel through these stations at desired different velocities to maximize the rate of sidewall erection, to optimize the rate of heat transfer to those surface areas of the blank to be welded together, and to minimize the open time between the heating and welding phases. The control system also optimizes the dwell time of the mandrel in a fourth station at which the heat plasticized, mutually contacting surfaces are pressed together to solidify or vulcanize, after which the mandrel is retracted, the formed tray being stripped therefrom by a means at the exit end of the die cavity. An electromechanical control circuit maintains a feed rate of individual blanks in phase with the extension and retraction cycle of the mandrel relative to the forming and welding die.

10 Claims, 10 Drawing Figures

Fig. 3
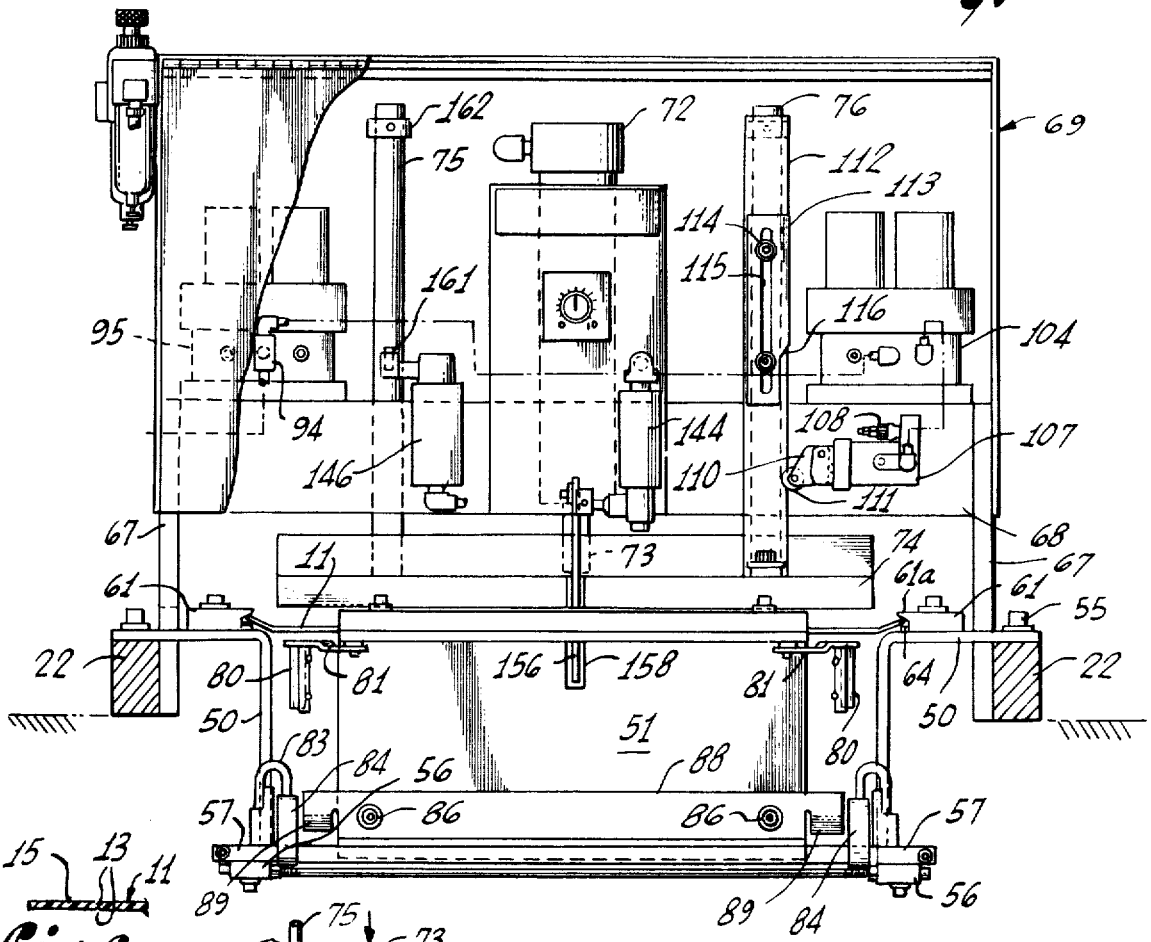
Fig. 8
Fig. 4
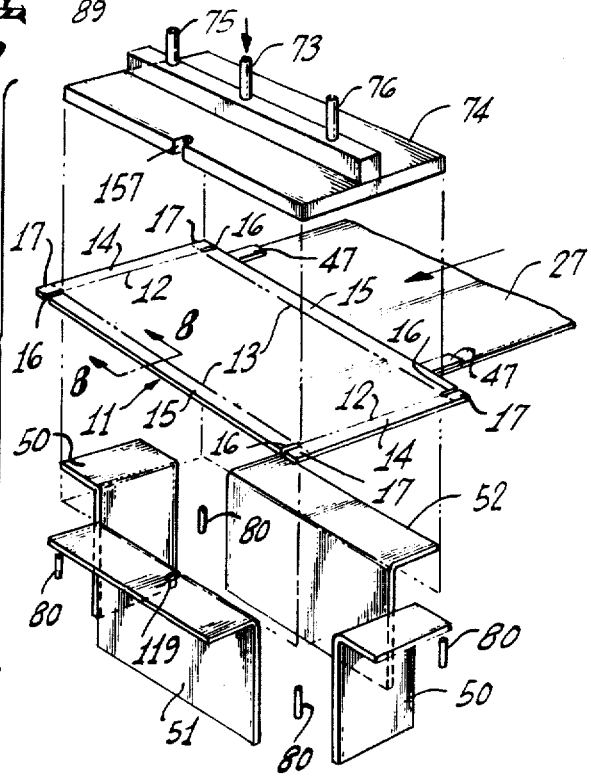
Fig. 5
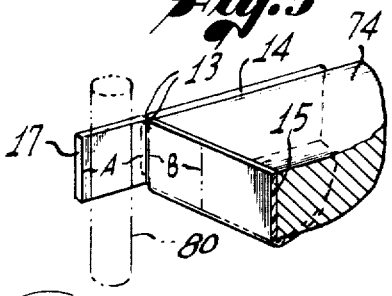
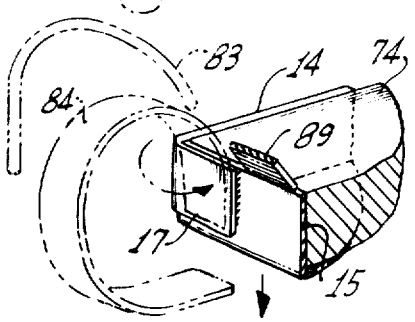
Fig. 6

TRAY FORMING AND WELDING MACHINE

BACKGROUND OF THE INVENTION

This invention relates to the heat welding of thermoplastic expanded foam materials in the form of essentially rigid sheets or blocks to form articles such as trays or other cushioning pads or shapes.

SUMMARY OF THE INVENTION

As embodied in a tray forming machine, the invention includes a die cavity in alignment with a mandrel that is reciprocable therethrough. A supply hopper for preformed tray blanks is mounted adjacent the die cavity on a table that also mounts a feed or kicker plate that is reciprocable through the hopper to singly thrust one blank out of the hopper into an indexed position over the die cavity.

The power means for the mandrel and kicker plate are coupled together in a control system to effect a retraction of return stroke of the kicker plate concurrently with the tray forming stroke of the mandrel into the die cavity and, also, to cause the kicker plate to dwell in a retracted position until the mandrel has been retracted out of the die cavity to a dwell position in readiness for another cycle of reciprocation. The control system includes an adjustable timer to vary the frequency of a cycle of operation of the apparatus.

During an initial increment of movement of the mandrel into the die cavity, at an initial relatively high velocity, opposed die plates of the cavity fold the opposite side walls of the blank around the edges of the mandrel into an erect position in which one pair of opposite side walls of the blank, each having opposite end foldable corner tabs, have their tabs projecting outwardly beyond the other erected pair of side walls. Voids are defined at the corners of the die cavity by the opposed pairs of die plates for the positioning of a radiant heat source in the vicinity of each corner of the erected tray, in confronting spaced relationship to those surfaces of the projecting corner tab and the adjacent corresponding side wall which are to be heat welded together. The rate of advance of the erected blank past the heat sources by the mandrel is selectively controllable so that the duration of application of heat is just sufficient to plasticize those areas which are desired to be welded together while minimizing or preventing heat transfer into the foamed material. Customarily, the rate of advance of the mandrel through the heating phase is at a lower velocity than the initial sidewall erecting velocity of the mandrel.

After the heating phase, the mandrel moves the tray through a corner tab folding station at a higher velocity, the tab folding being accomplished by a camming means co-acting with the mandrel. With this arrangement, the heated areas to be welded together are brought into mutual contact, without relative sliding movement therebetween, and, due to the increased velocity of the mandrel, the open time between the heating and welding phases is held to a minimum to minimize dissipation of heat from the plasticized surfaces. Immediately upon completion of the tab folding phase, the mutually contacting and heated surfaces are biased together during decelerating movement of the mandrel, during which the welding process is completed. Thereafter, the mandrel is retracted out of the completely formed tray and out of the die cavity while the completed tray is stripped from the mandrel by stripper bars positioned at the exit end of the die cavity.

BRIEF DESCRIPTION OF THE DRAWINGS

FIG. 3 is an end view of the tray forming section of the apparatus of FIG. 1, portions being cut away to reveal interior components thereof.

FIG. 4 is a schematic, exploded perspective view of certain elements of the tray forming section of the apparatus.

FIG. 5 is a partial perspective view illustrating the configuration of a corner area of the tray blank after passage through the sidewall erecting phase and during passage through the radiant heating station, the heater being illustrated in phantom outline.

FIG. 6 is a schematic, partial perspective view of a corner area of the tray during the welding dwell phase and immediately after passage through the tab following station.

FIG. 8 is a partial sectional view on the line 8-8 of FIG. 4, on an enlarged scale, showing details of the tray blank construction.

Figure 1:
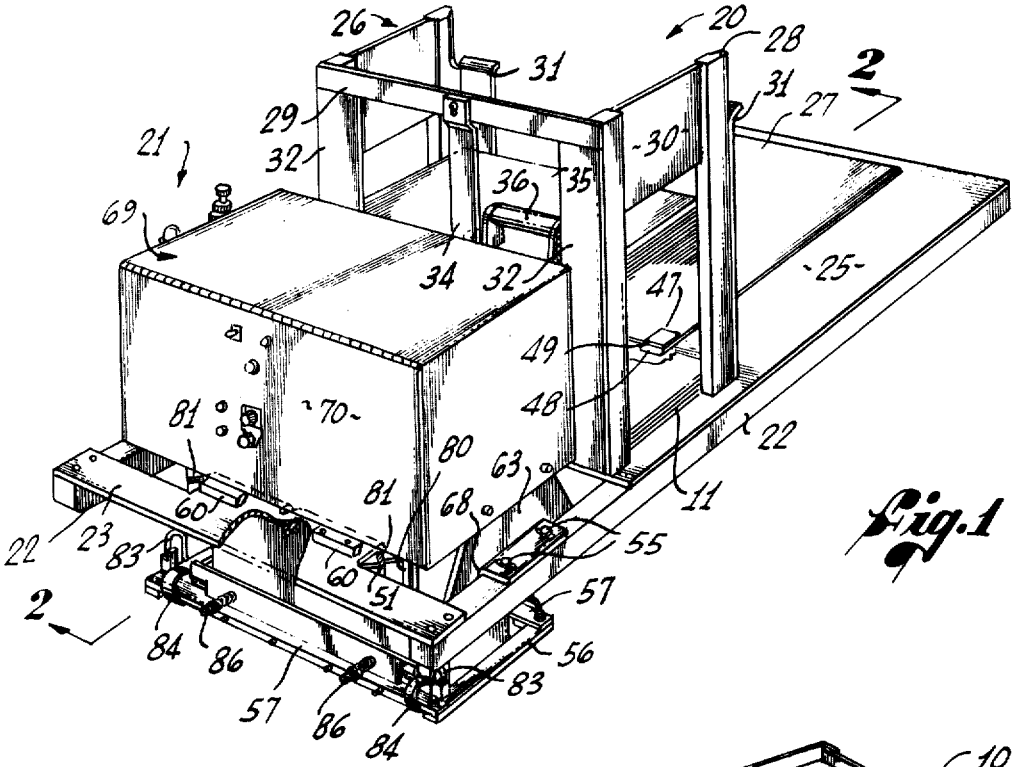
FIG. 1 is a perspective view of an apparatus embodying the invention, with portions thereof being broken away to reveal certain interior details of construction.
Figure 7:
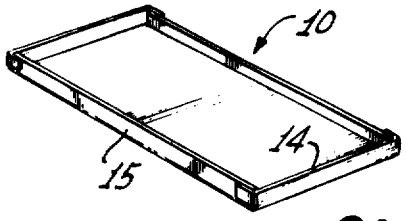
FIG. 7 is a perspective view of the completed tray produced by the apparatus of FIG. 1.

Referring to the drawings, the apparatus illustrated in FIG. 1 is especially adapted for the manufacture of protective trays 10, of the configuration illustrated in FIG. 7, made from foamed polystyrene sheet stock. However, the invention may be embodied in other forms of apparatus for the production of articles of different configurations made from sheets, slabs or blocks of other essentially rigid foamed thermoplastic materials such as expanded polyethylene, expanded polypropylene, expanded polyurethane or expanded polyvinyl chloride, or material provided with an extremely thin film coating of a thermoplastic material such as polyethylene. Accordingly, it is to be understood that the following description of the presently preferred embodiment of the invention is illustrative, and not limitative.

FIG. 4 includes a perspective view of the planform of a tray blank 11 that is made of foamed polystyrene which may be on the order of 45–60 mils in thickness. The blank 11 is preformed with two opposite pairs of hinge line grooves 12 and 13 on both surfaces which define those areas of the blank which will constitute two opposite pairs of sidewalls 14 and 15. The tray blank 11 is also formed with four notches 16 to define foldable corner tabs 17 which are extensions of those portions of the blank which will be turned up to make the walls 14. FIG. 5 represents an intermediate step in the formation of the tray in which the corner tabs 17 remain coplanar with the corresponding wall 14. At this phase of the operation, a source of heat plasticizes the adjacent confronting skin or surface A of the corner tab 17 and a corresponding area B on the confronting surface of the wall 15 by radiation. As is illustrated in FIG. 6, the heated areas A and B are thereafter immediately brought into mutually contacting abutment to permit welding solidification thereof to occur while the mutually contacting areas are briefly pressed together.

Referring to FIG. 1, the apparatus generally comprises a hopper and feed section 20 and a forming section 21 for converting a blank 11 into the tray 10 illustrated in FIG. 7. A base frame for the machine includes an opposite pair of side frame members 22 having their ends adjacent the forming section 21 rigidly interconnected by a cross bar 23. The hopper and feed section 20 of the apparatus includes a sheet member 25 rigidly secured on top of the framework providing a table on which a supply hopper 26 and a feeder or kicker plate 27 are mounted.

As is shown in FIG. 1, the supply hopper 26 is adapted to contain a stack of the tray blanks 11. Preferably, the hopper is open sided, comprising four corner posts 28 having their lower ends rigidly secured to the table 25. A front pair of the posts may be rigidly interconnected at their upper ends by a girder strap 29 and the hopper may be partially closed at its opposite sides by plates 30 each of which extends between a corresponding pair of side posts. The rear pair of posts 28, at least along a major portion of the rear face thereof, are provided with retainer straps 31, which confront vertically extending retainer straps 32 secured to the front pair of posts 28. The retainer straps 31 have their lower ends terminating at the surface of the table 25 to prevent rearward displacement of blanks as the kicker plate is retracted.

A vertically adjustable material thickness gauge is provided at the front of the hopper 26 to prevent all but the lowermost one of the stack of blanks 11 within the hopper from being fed into the forming section by the kicker plate 27. This may take the form of a vertically extending strap 34 having its uppermost end adjustably secured to the midpoint of the transverse hopper strap 29 and having its lower end similarly secured to a transverse girder strap adjacent the lower end of the hopper. It will, of course, be understood that the framing elements of the hopper 26 internally define a cross sectional area and planform to closely complementarily receive a stack of horizontally disposed tray blanks 11. Because of the low density of the expanded foam material, a column of the blanks may not provide sufficient gravitational force to bias the lowermost one into flat conforming relationship to the surface of the table 25. Accordingly, a weight plate 35 may be placed within the hopper on top of a stack of the blanks 11, the weight plate being provided with a handle 36 to facilitate its removal and replacement upon periodic replenishment of the diminishing supply of blanks within the hopper.

The kicker plate 27 is slideably secured to the top of the table 25 for rectilinear reciprocation. Thus, the table 25 is centrally longitudinally formed with an elongated slot 39 and a parallel pair of slots, not shown, flanking the central slot and longitudinally offset therefrom. Each of the latter slots slideably mounts a slider clamp 41. Similarly, the central slot 39 is provided with a slider clamp 42 of inverted T-shape configuration having its central stem portion secured to a rear portion of the underside of kicker plate 27. Secured to the underside of the table 25, by means of a bracket 43, is a pnuematic cylinder 44 having a piston rod 45 reciprocating through the rearwardly facing end thereof to have its rear end connected, through a clevis 46, to the central slider clamp 42. As will be apparent, upon reciprocation of the pneumatic piston within the cylinder 44, kicker plate 27 is reciprocated into and out of the lower end of the hopper 26 to singly feed a tray blank 11 into the forming section 21. Along its forward edge, the kicker plate is provided with a spaced pair of tray blank pick up and pusher elements 47. Preferably each of these is formed with a knife edge projection 48 extending forwardly beyond the forward end of the kicker plate 27 and tapering rearwardly to a forwardly facing shoulder 49, which may be given a forwardly inclined rake angle so as to securely wedgingly engage the rearmost edge of a tray blank 11 for pushing it into the forming section 21.

Referring to FIG. 4, the die cavity comprises an opposed pair of side die plates 50 and an opposed pair of a front die plate 51 and a rear die plate 52. The four die plates have identical vertical cross sectional profiles, being of inverted L-shaped cross sectional configuration having horizontal and vertical flanges joined by an arcuate section along a predetermined radius in order to effect a folding of the tray wall sections 14 and 15 at a desired rate as the mandrel forces the tray blank into the die cavity. From FIG. 4 it will be observed that the forming curve sections of the pair of die plates 50 are shorter than the tray wall portions 14 and that the curved forming sections of the front and rear die plates 51 and 52 are shorter than the wall portions 15 of the tray blank. Voids or clearance spaces are thus provided at each corner of the die cavity to receive the heater, corner tab folding, and welding dwell elements.

Referring to FIG. 3, each of the pair of side die plates 50 has its horizontal flange secured to a corresponding one of the side frame members 22 by a suitable fastener means 55. As is best seen in FIG. 1, the lower end of each die plate 50 has a framing strap 56 rigidly secured thereto, externally of the die cavity, and the extremities of the pair of straps 56 are rigidly interconnected by a pair of framing straps 57 which are secured to the front and rear die plate 51 and 52 externally of the die cavity. As is indicated in FIG. 1, the horizontal flange of the forward die plate 51 may comprise an integral rearward extension of the frame member 23. The rear die plate 52 may have its horizontal flange formed as an integral forward extension of the table 25 or, alternatively, may be secured in the desired location by a transverse framing members of the base framework of the apparatus. In any event, it will be understood that the die plates 50, 51 and 52, when assembled in the apparatus, constitute a rigid box-like die cavity structure having voids at the four corners thereof.

The upwardly facing surfaces of the horizontal flanges of all four die membes are coplanar with the upper surface of the table 25 and, in effect, provide a coplanar extension thereof. In order to index a tray blank 11 in the desired position over the die cavity, a stop member 60 is affixed to the top of and extends across the length of the horizontal flange of the forward die member 51, while one of a pair of side guide members 61 is secured on top of each of the pair of opposite side die members 50. In order to prevent rebound of a tray blank 11 from the front stop member 60, the hopper 26 is provided along its lower end front exit with an elongate hold down member 62 (FIG. 2) comprising a thin sheet of a flexible material, e.g., half hard stainless steel, whose forward edge is adapted to lightly bias the trailing edge of a tray blank onto the upper face of the horizontal flange of the rear die member 52. As is shown in FIG. 3, each of the pair of side guides 61 is formed with an inwardly directed lip 61a adapted to overlie a corresponding side edge of the tray blank 11. At the forwardmost ends of each of the side guides 61, a forwardly tapering member 64 may be secured to initially deflect corresponding forwardmost portions of the wall areas 14 upwardly out of the plane of the body of the tray blank.

The framework for mounting the mandrel and its power and control system includes an opposed pair of side plates 67, each of which is secured to an inner face of one of the side frame members 22 to project upwardly thereabove. As is shown in FIG. 1, each of these side plates is formed with an aperture to permit the extension therethrough of the corresponding one of the side die members 50. The apex areas of the upper ends of the pair of side plates 67 are rigidly interconnected by a box beam structure 68 to provide a rigid framework for supporting the power and control components and, also, a sheet metal housing 69, the front panel of which comprises a hinge supported door 70.

Internally of the housing 69, the beam 68 centrally supports a vertically disposed double acting fluid (e.g., pneumatic) cylinder 72 having a downwardly extending piston rod 73 whose lower end is rigidly secured to the center of a rectangular mandrel 74. On opposite sides of the cylinder 72 the beam 68 provides bearing support for a pair of vertically reciprocable mandrel stabilizing and guide rods 75 and 76 which also have their lower ends rigidly secured to the mandrel 74.

The mandrel 74 has a planform that is substantially congruent to the planform of the floor of the completed tray 10 and, preferably, an edge thickness or depth at least as great as the height of the erected side walls 14 and 15 of the tray. In addition, the inner vertical faces of the die plates 50, 51 and 52 are spaced from the periphery of the mandrel 74 a distance which is substantially equivalent to the thickness of the sheet stock of the tray 11. Accordingly, referring to FIG. 3, when the mandrel 74 descends it engages that area of the blank 11 bounded by the hinge lines 13. Upon further advance of the mandrel into the die cavity, the side walls 14 and 15 are cammed or turned upwardly into the erect position by the curved portions of the die plates 50, 51 and 52 and, upon further advance of the mandrel into the die cavity, are constrained into the erect position against the edges of the mandrel 74 by the surrounding interior surfaces of the four die plates.

The initial increment of movement of the mandrel 74 into the die cavity thus transports the blank 11 through a side wall erecting phase. Immediately thereafter, an additional increment of movement of the mandrel carries the blank through a heating station in which the areas A and B of each corner are subjected to a source of radiant heat, as indicated in FIG. 5. Further extension of the mandrel into the die cavity carries the tray blank through a corner tab folding station and into a station at which the areas A and B at each corner, having been brought into mutual contact, are biased together for a sufficient period to permit welding solidification of the plasticized surfaces.

The heating station is provided by four electrical resistance heating elements 80, each of which is mounted from a bracket 81 secured to the die cavity framework and from which it is electrically and thermally insulated by suitable means. Thus, referring to FIG. 3, a pair of the brackets 81 may be secured at one end to the underside of the horizontal flange of the front die plate 51 to project angularly relative to the vertical flange thereof and into the open corner area of the die cavity. Preferably, the heater elements 80 take the form of resistance heating elements of cylindrical form, e.g., sealed "Calrod" units, having their longitudinal axes equidistantly spaced from the areas A and B exposed thereto when the side walls 14 and 15 of the tray blank have been erected to the positions shown in FIG. 5. While not specifically illustrated, it will be understood that the brackets 81 for the rear pair of heaters 80 may be secured to the underside of the horizontal flange of the rear die plate 52, in locations symmetrically corresponding to that of the front pair of heater elements 80, for heating the corresponding areas A and B during the downward passage of the tray blank therepast after the corresponding wall portions 14 and 15 have been erected.

After the areas A and B have been plasticized, the corner tab 17 at each corner is turned through 90° by a camming means, which may take the form of a curved rod 83. Each of the four rods 83 may be secured at one end to the side frame member 56 at the lower end of the die cavity to extend upwardly therefrom, thence to curve inwardly to intercept the lower edge of the tab and deflect the corresponding corner tab 17 to bring the plasticized areas A and B into abutment against the corresponding edge area of the mandrel 74. At each open corner of the die cavity, a spring band 84 has one end secured to an end portion of one of the transverse frame members 57 to extend through approximately 270° of arc to present a free end with a surface confronting one side of the mandrel 74 and spaced therefrom approximately twice the thickness of the sheet stock material from which the tray is made but with the spacing such as to provide a slight interference whereby those portions of the side walls 14 and 15 including the areas A and B are compressed between the operative face of the spring 84 and the side wall of the mandrel.

The front die plate 51 and rear die plate 52 are each externally provided with a means for stripping the formed tray from the mandrel 74. Thus, as is shown in FIG. 3 with respect to the front die plate 51, a laterally spaced pair of stud bolts 86 have their shanks rigidly secured to the external face of the vertical flange of the die plate 51 and each is provided with a compression spring 87 between a head of the stud and one surface of a stripper plate 88 that is mounted on the pair of studs 86. The springs 87 normally bias the plate 88 into flush engagement with the external face of the die plate 51. At opposite ends, the plate 88 projects laterally beyond vertical edges of the die plate 51 terminating in stripper tabs 89 having lowermost edges projecting inwardly relative to the die cavity sufficiently to interfere with the passage of the corresponding side wall 15 therepast. Upon such interference, the stripper plate 89 is biased or cammed outwardly, sliding on the studs 86, permitting passage of the corresponding side wall 15 whereupon the tray enters the welding dwell station depicted in FIG. 6. After the welding of the corner tabs has been completed, and upon retraction of the mandrel 74, the stripper tabs 89 have returned to engagement with the upper edges of the side walls 15, preventing return movement of the completed tray with return movement of the mandrel.

Figure 10:
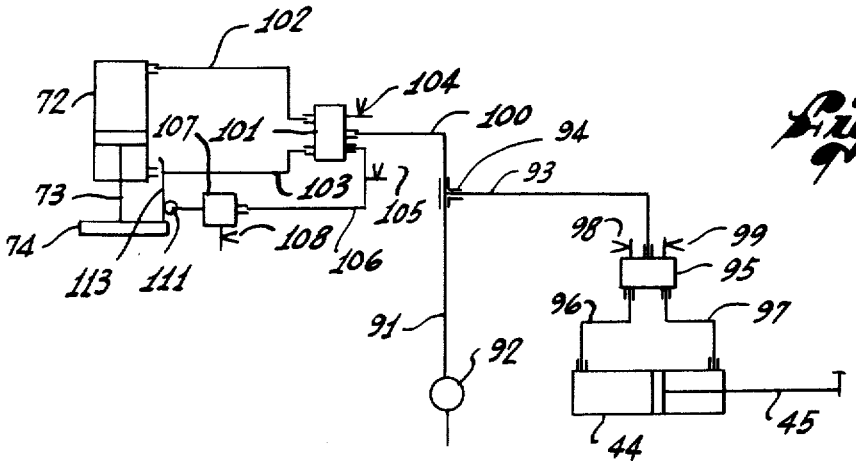
FIG. 10 is a schematic diagram of the mandrel power and control system.

As is shown in FIG. 10, both the mandrel cylinder 72 and kicker cylinder 44 have communication with a source of compressed air via a conduit 91 which incorporates a pressure regulator 92. A conduit 93, out of a Tee fitting 94 in the supply line, has communication with a control valve 95 through which the compressed air is supplied by conduits 96 and 97 to opposite ends of the housing of the kicker cylinder 44 to effect controlled reciprocation of the kicker plate 27. It will, of course, be understood that the kicker cylinder 44 has a stroke greater than the corresponding dimension of the tray blank 11 to be fed out of the hopper 26. The control valve 95 is provided with a pair of exhaust flow restrictors 98 and 99 for adjusting the velocity of the piston rod extension and retraction strokes of the cylinder 44.

Similarly, another conduit 100 out of the Tee fitting 94 has communication with a mandrel cylinder control valve 101 having conduits 102 and 103 to opposite ends of the housing of the mandrel cylinder 72, the control valve 101 also being equipped with adjustable exhaust flow restrictors 104 and 105. The latter flow restrictor is connected in series, via a conduit 106, with a cam actuated dump valve 107 which is also provided with an adjustable exhaust flow restrictor 108.

Figure 2:
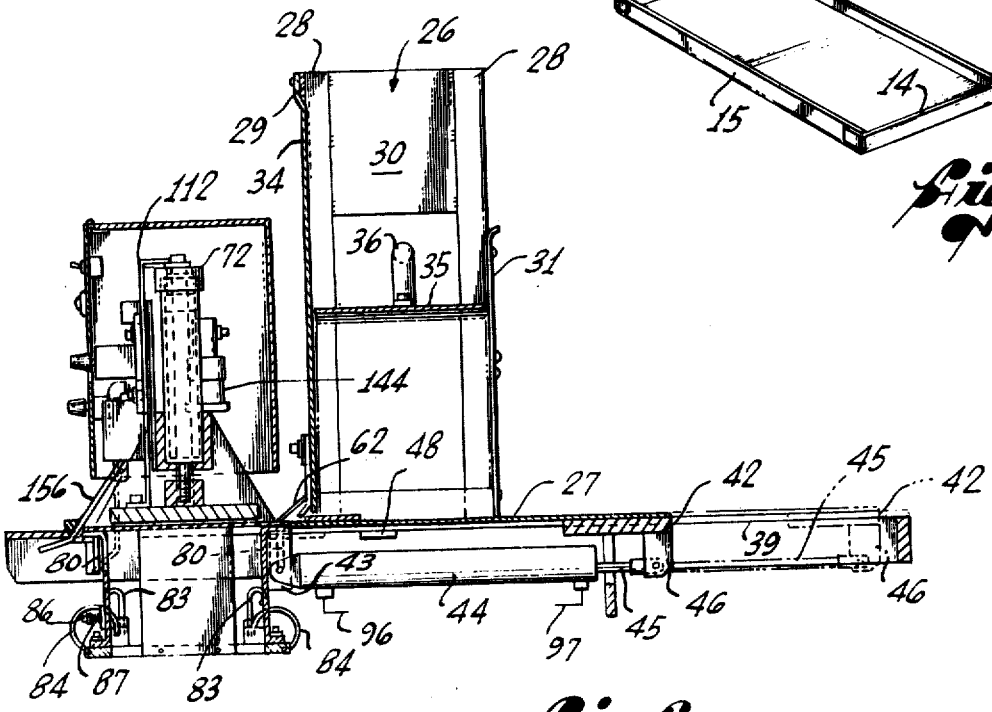
FIG. 2 is a longitudinal sectional view taken on the line 2—2 of FIG. 1.

Referring to FIG. 3, it will be seen that the mandrel cylinder control valve 104 and kicker cylinder control valve 95 are mounted on top of the box beam 68, within the housing 69. The dump valve 107 is mounted on the beam 68 adjacent the mandrel control valve 104 and is provided with a pivotally mounted control arm 110 whose free end mounts a roller 111. The mandrel support rod 76 has the upper end of a strap 112 secured thereto, the lower end of this strip being secured to the upper face of the mandrel 74. As is indicated in FIG. 2, the strap 112 is forwardly offset from and parallels the support rod 76. The front face of this strap vertically adjustably mounts a cam plate 113 by a pair of fasteners 114, carried by the strap 112, and extending through a central longitudinally extending vertical slot 115 of the cam plate. The cam plate 113 is disposed in the same vertical plane as the dump valve roller 111 and, on one edge, is formed with a downwardly facing cam edge 116 which develops upwardly into a vertically extending roller track edge of predetermined length.

In FIG. 3, the mandrel 74 is shown in a fully raised position with a tray blank 11 indexed over the die cavity. Upon actuation of the mandrel control valve 104 to admit compressed air to the upper end of the mandrel cylinder 72, the mandrel 74 is caused to descend at a relatively high velocity to carry the mandrel through the side wall erecting station of the die cavity. This first station of the cavity may be viewed as the vertical distance between the solid outline position of the mandrel 74 shown in FIG. 3, and a lower position in which the lower face of the mandrel occupies a plane intersecting upper ends of the heaters 80 or a plane beneath a junction of the curved surfaces of the four die plates and the internal vertically extending flat surfaces of the die plates. A relatively high velocity of the mandrel through this first station is attained since the area of the underside of the piston is less than the upwardly facing or topside area of the piston, due to the presence of the cross sectional area of the piston rod 73 while, at the same time, the lower end of the cylinder 72 is vented to atmosphere through the exhaust orifice 105.

As the mandrel 74 approaches the terminal portion of its passage through the first station of the die cavity, the internal pressure within the housing of the cylinder 72 under the piston increases until a desired predetermined imbalance of the pressure differentials acting on the piston is achieved. The desired degree of imbalance may be attained by appropriate adjustment of the flow regulator 105. The mandrel 74 then proceeds downwardly through the die cavity for the length of the heaters 80 and so passes through the heating station illustrated in FIG. 5 and at a lower velocity than its velocity through the first station. The velocity of the mandrel through the heating station may be adjusted by adjustment of the exhaust flow orifice 105.

Upon or immediately after the lower face of the mandrel 74 passing through the plane of the lower ends of the heaters 80, the cam surface 116 of the cam plate 113 engages and depresses the pivotally mounted dump valve roller 111. As a result, air pressure is relieved from the lower end of the mandrel cylinder 72 through the exhaust orifice 108 at a more rapid rate than the rate permitted by the exhaust orifice 105 alone. As will be apparent, the duration of this accelerated rate of exhaustion is a function of the length of the track of the member 113. Preferably, the track length is substantially the same as the spacing between the plane of the lower ends of the heaters 80 and the plane of the downwardly pointing stripper tabs 89, which spacing includes the tab folding elements 83 and spring biasing elements 84. Because of the increased velocity, the open time between the radiant heating station and tab folding station of the die cavity is minimized to minimize dissipation of heat from the plasticized surfaces A and B.

Conventionally, pneumatic power cylinders (e.g., Wabco Task master) are provided with cushion adjustment valves at each end. Accordingly, as the mandrel 74 reaches the extremity of its extension stroke, the cushion adjustment valve (which may be adjusted as desired) effects a deceleration of the downward velocity of the mandrel, just prior to reversal of the stroke. The formed tray is then in the position relative to the pressure spring 85 illustrated in FIG. 6, wherein the tab 17 has been turned through 90° to bring the plasticized areas A and B into mutual contact for their welding solidification. Accordingly, as a result of proper adjustment of the cushion adjusting valve of the cylinder 72, the mandrel downward velocity through the welding pressure phase of the mandrel stroke is at a greatly decelerated rate, as compared to the passage of the mandrel through the tab folding station in the open time period, thus maximizing efficient utilization of the heat which has been transferred to the areas A and B.

Figure 9:
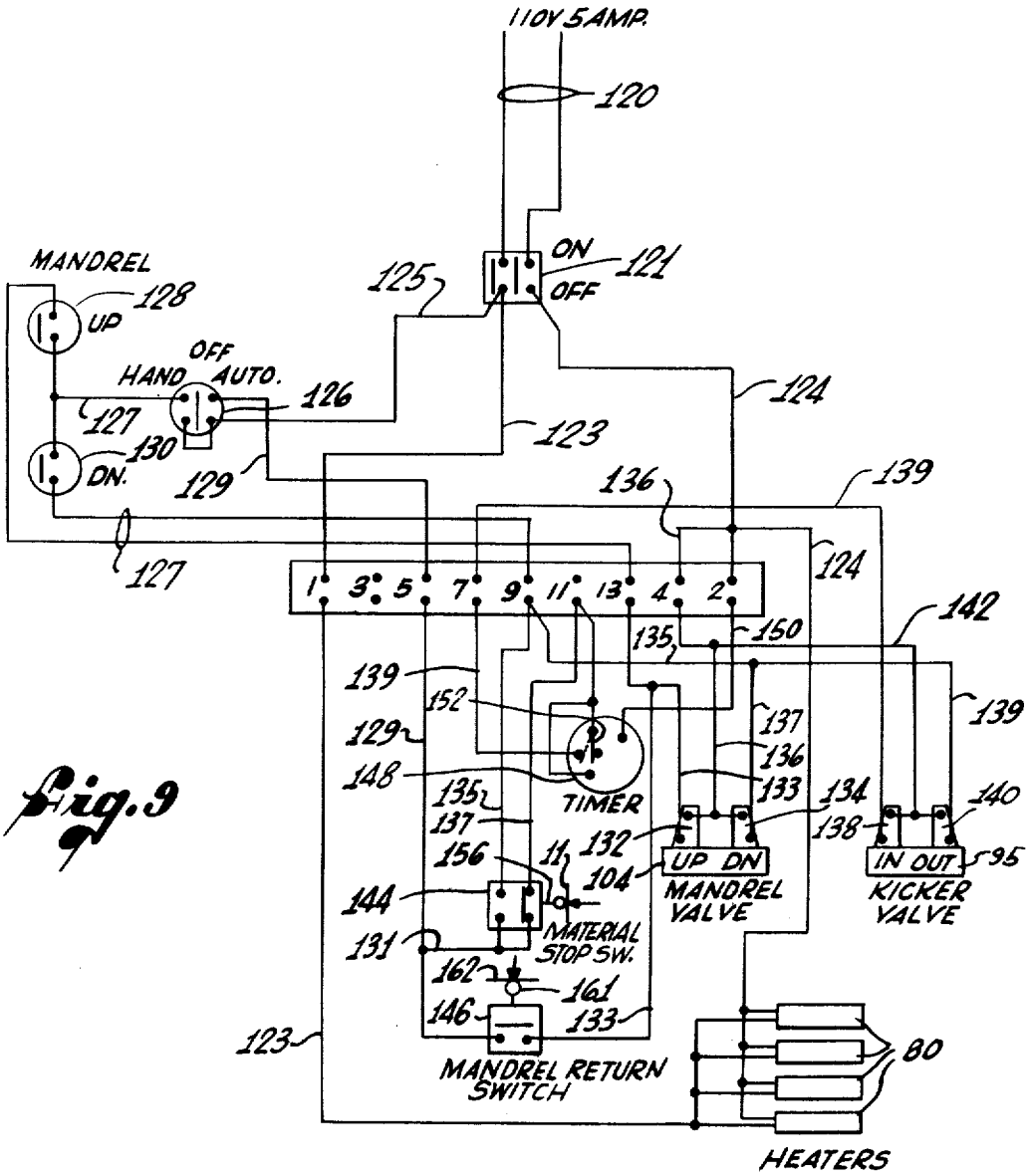
FIG. 9 is a schematic diagram of an electromechanical control circuit for the apparatus of FIG. 1.

Referring to FIG. 9, the control system for the apparatus includes a power circuit 120 having a master switch 121. Opposite sides 123 and 124 of the heater power circuit are connected directly to the master switch so that the heaters 80 are energized downwardly upon closing of the master switch.

A conductor 125 extends from one side of the master switch 121 to one side of a mode selector switch 126. As is indicated in the figure, the selector switch 126 is provided with hand feed, off, and automatic feed positions. When the selector switch is in the hand feed positions, either one of a manual mandrel "up" switch 128 and a manual mandrel "down" switch 130 may be closed to close one side 127 of a circuit controlling actuation of the mandrel valve 104. The mandrel valve 104 includes a pair of solenoids 132 and 134 having a common line connection 136 to the side 124 of the power circuit. With this arrangement, either of the parallel switches 128, 130 may be closed to effect extension or retraction of the mandrel. Thus, in the event that any of the tray blanks 11 becomes jammed within the die cavity during the forming process, the selector switch 126 may be turned to the hand feed mode and the mandrel manipulated as desired to accomplish unjamming.

When the selector switch 126 is turned to the automatic mode, power is supplied to one side 129 of a circuit to effect synchronous, properly phased reciprocation of the mandrel cylinder 72 and the kicker cylinder 44. The kicker valve 95 includes solenoids 138 and 140 having a common line 142 comprising a parallel extension of the common line 136 for the mandrel valve solenoids and constituted the other side of the circuit for automatic operation of the kicker valve.

The side 129 of the automatic circuit includes a conductor 131 to a parallel pair of terminals of a material stop switch 144. The solenoid 132 of the mandrel valve, when energized, effects operation of the valve to divert compressed air into the lower end of the mandrel cylinder 72. The solenoid 132 is connected to the side 129 of the automatic circuit by a conductor 133 that includes a normally open mandrel return switch 146.

Through a position 13 of a terminal strap the mandrel "up" solenoid 132 is also connected in series with the side 127 of the hand feed circuit so that the solenoid 132 may be energized by depression of the manual switch 128.

The material stop switch 144 has another pair of parallel terminals. A conductor 135 from a normally open one of the pair of terminals extends through a position 9 on the terminal strap (which is in series with the side 127 of the hand feed circuit) to have the mandrel "down" solenoid 134 and kicker "out" solenoid 140 connected thereto in series by conductors 137 and 139.

The remaining terminal of the material stop switch 144 is connected by a conductor 137 through a position 11 of the terminal strap to a parallel pair of terminals of an adjustable automatic timer 148. When the material stop switch 144 is in the normally closed position shown, the conductor 137 and its parallel pair of terminals within the timer 148 are normally connected to the side 129 of the automatic circuit. Another terminal of the timer 148 is connected to the other side of the power circuit by a conductor 150 through a position 2 of the terminal strap. One of the parallel pair of terminals of the timer 148 includes a normally closed switch 152 whose duration of closure can be adjusted to vary the time period during which the kicker "in" solenoid 138 is held in an open condition. After the preset period of time, the switch 152 contacts a fourth terminal of the timer which is connected to a conductor 139, passing through terminal strap position 7, for connection to a terminal of the kicker "in" solenoid 138.

Referring to FIG. 3, the material stop switch 144 is mounted on the front face of the box beam 68 and is provided with a downwardly depending switch actuating arm 156. As is shown in FIG. 2, the switch arm 156 is normally biased to the substantially vertically extending position indicated in phantom outline but is deflectable to the full line position by the leading edge of a tray blank 11 being thrust into indexed position over the die cavity. In order to provide clearance for the movement of the switch arm 156 between the indicated positions, the mandrel 74 is formed with a notch 157 in its forward edge and the front die plate 51 is formed in both its horizontal and vertical flanges with a slot 158 to register with a clearance notch 159 formed in the rear edges of the stop member 60.

Still referring to FIG. 3, the mandrel return switch 146 is also mounted on the front face of the beam 68 and at its upper end is provided with a switch arm 161 that is disposed in vertical alignment with a switch actuator 162 carried at the upper end of the mandrel support rod 75. Thus, when the mandrel descends under the force of the cylinder 72 the normally open mandrel return switch 146 is closed upon the actuator 162 coming into engagement with and depressing the switch arm 161, to initiate a return stroke of the piston of the cylinder 72.

With the power switch 121 in the "on" position and with the mode selector switch 126 in the "automatic" position, the sequence of operations of the apparatus is as follows.

The timer 148 is of a type, e.g., Industrial Solid State Controls (I.S.S.C.) model 1017 B-1, which automatically resets itself to a zero or start position upon deenergization or by operation of the material stop switch. Such restart or zero position is indicated by the solid line position of the switch arm 152 in FIG. 9, bearing against a limit post and out of contact with the terminal of the timer for the conductor 139. At the same time, it will be understood that the timer circuit is closed on the side 129 through conductors 131 and 137 and on the other side through the conductors 124 and 150. Accordingly, after lapse of the preset period of time for which the timer 148 is set, e.g., one tenth of a second, the switch arm 152 will come into electrical contact with the timer terminal for the conductor 139, as shown by the dotted line position.

Upon closing of the switch arm 152, the kicker "in" solenoid 138 is energized to operate the kicker valve 95 for admission of compressed air through the conduit 97 to effect movement of the kicker plate 27 into the lower end of the hopper 26 to feed a tray blank 11 into indexed position over the die cavity. The leading or front edge of the tray blank 11 moves the switch arm 156 to the left, as viewed in FIGS. 2 and 9, thus opening the conductor 137 of the timer circuit and closing the conductor 135 to effect simultaneous energization of the mandrel "down" solenoid 134 and the kicker "out" solenoid 140. As a result, the mandrel valve 104 is operated to admit compressed air into the upper end of the pneumatic cylinder 72 to carry the mandrel 74 downwardly into the die cavity. At the same time, the kicker valve 95 is operated to admit compressed air through the conduit 96 into the kicker cylinder 44 to move the piston rod 45 outwardly to withdraw the kicker plate 27 from the hopper 26. The material stop switch 144 returns to the right hand position indicated in FIG. 9 to close the conductor 137, reenergizing the timer 148 with the switch element 152 having been returned to the restart position shown in solid line in the figure.

The mandrel 74 descends through the stations of the die cavity at different velocities in the manner previously described until the tray 10 has been formed, whereupon the actuator 162 carried by the mandrel guide rod 75 engages the switch arm 161 to operate the mandrel return switch 146. As a result, the conductor 133 is closed to energize the mandrel "up" solenoid 132, effecting operation of the mandrel valve 104 to admit compressed air into the lower end of the mandrel cylinder 72. The mandrel is thus raised to uppermost position, after which the automatic cycle of operation recommences after expiration of the time period set into the timer 148, which again closes element 152 on the timer terminal for the conductor 139.

Foamed thermoplastics such as polyethylene, polypropylene, polystyrene, polyurethane and polyvinyl chloride have use temperatures within a range of about 150° to about 290° F. Such materials, if subjected to temperatures of over 300° F., will melt, vaporize or decompose. However, with the present invention, advantage can be taken of the low thermal conductivity of the foamed material to subject one surface thereof to temperatures greatly in excess of the melt, vaporization or decomposition temperature, the exposure time being so controlled that those surface areas which are desired to be welded are plasticized without plasticizing the opposite surface of these areas or the mass of foam material intermediate the inner and outer surfaces.

As an example, with foamed polystyrene, having a melt temperature of 325° - 350° F., on the order of 45 mils in thickness, trays 10 with corner tabs approximately ¾ of an inch square and, therefore, surface areas A and B of about the same area have been subjected to radiant heaters having a surface temperature of 1600° F., spaced on the order of ⅛ of an inch from the skin surfaces A and B, for periods of from 2/10 to 5/10 of a second, i.e., the range of exposure time of a given point on the surfaces A and B in passage through the heating station of the illustrated apparatus. The optimum time of heat exposure for this material appears to be on the order of 3/10 of a second under the stated conditions. Thus, trays 10 have been formed, with the blank moving through the die cavity at the various relative velocities previously indicated, to pass radiant heaters of cylindrical configurations having a 2 inch length within 3/10 of a second and with the cushion valve at the lower end of the hydraulic cylinder adjusted for maintenance of pressure upon the mutually contacting plasticized surfaces in the range of ½ of a tenth to 5/10 of a second and, optimally, for 2/10 of a second, resulting in trays whose corners are securely welded in the areas A and B and without significantly altering the thickness dimensions of the corner material.

As will be apparent, the surface temperatures of the radiant heat source and the spacing between the heat source and the surfaces to be welded, the time of exposure in the heating phase, the open time between the heating station and the welding pressure station, can all be varied as desired to achieve optimum conditions for the type of material being worked upon. In addition, while the invention has been disclosed and described with reference to the forming of a packaging article out of a single integral blank form and in an apparatus which may be broadly characterized as of the punch and die type, it will be appreciated by those skilled in the art that other types of apparatus may be employed, for example, to handle separate pieces of material, predetermined areas of which are to be heat welded together. Thus, molded parts, planks or boards of expanded foam thermoplastics in the form of separate pieces may be moved in unison, or substantially so, past a radiant heat source of very high temperature and then brought together at an accelerated rate to have the plasticized surfaces heat welded together.

I claim:

1. Apparatus for erecting and heat welding flat blanks with foldable walls having thermoplastically bondable pairs of corner joint areas, one of said joint areas comprising a corner tab extension of a wall of the blank and the other of said joint areas comprising the corresponding area of another wall onto which the corner tab is to be folded after erection of the foldable walls, said apparatus comprising;

a die cavity including rigidly fixed die walls;

a mandrel mounted for reciprocation into and out of said die cavity;

one end of said die cavity having a first station comprising camming surfaces of said die walls to fold the walls of the blank into erected position when said mandrel initially enters said cavity;

adjacent ends of said die walls defining corner voids of said die cavity providing clearance for the extension therethrough of an unfolded corner tab and for the exposure therethrough of the corresponding area of an erected wall onto which the corner tab is to be folded through said void;

said die cavity having a second station, intermediate opposite ends of said die cavity, comprising a heat source for each of said corner voids, each of said heat sources being positioned and arranged for heating a corresponding pair of corner joint areas during a second increment of movement of said mandrel and blank into said die cavity through said second station;

and a third station of said die cavity comprising means at each of said corner voids to fold the corner tab through said void to bring the thermoplastically bondable corner joint areas of the blank into mutual contact during a third increment of movement of said mandrel into said die cavity.

2. An apparatus as in claim 1 that includes a power means for moving said mandrel into said die cavity at different velocities during movement of said mandrel through two, at least, of said stations.

3. An apparatus as in claim 2 in which said power means includes a control system having selectively adjustable means to vary the time elapsing during passage of said mandrel through said second station.

4. An apparatus as in claim 5 in which said power means comprises a fluid cylinder and said selectively adjustable means comprises an exhaust flow restrictor for said cylinder.

5. An apparatus as in claim 2 in which said power means moves said mandrel into said die cavity at a lower velocity through said second station than through said third station for reducing the open time between heating and folding of the thermoplastically bondable corner joint areas of the blank.

6. An apparatus as in claim 5 in which said power means includes a control system having a selectively adjustable means to vary the time elapsed in passage of said mandrel through said third station.

7. An apparatus as in claim 6 in which said power means comprises a fluid cylinder and said selectively adjustable means comprises a means to translate exiting of said mandrel from said second station into actuation of a valve adapted to accelerate exhaust flow from said cylinder.

8. An apparatus as in claim 1 that includes a means for applying welding pressure to the heated and folded thermoplastically bondable, mutually contacting, corner joint areas of the blank during a fourth, terminal increment of movement of said mandrel into said die cavity.

9. An apparatus as in claim 8 that includes a power means with a control system for moving said mandrel through said second and third station at different velocities and for moving said mandrel during said fourth terminal increment of movement at a velocity which is the least of the three velocities.

10. An apparatus as in claim 9 in which said power means comprises a pneumatic cylinder having a selectively adjustable cushion valve for controlling the velocity of said mandrel during said fourth terminal increment of movement thereof to adjustably prolong the duration of application of said means for applying welding pressure.

* * * * *

UNITED STATES PATENT OFFICE

CERTIFICATE OF CORRECTION

Patent No. 3,955,482 Dated May 11, 1976

Inventor(s) Lenard E. Moen

It is certified that error appears in the above-identified patent and that said Letters Patent are hereby corrected as shown below:

Column 1, line 22, change the first "of" to --or--.

Column 2, line 24, change "following" to --folding--.

Column 4, line 46, change "members" to --member--.

Column 8, line 53, change "downwardly" to --immediately--.
line 60, change "positions" to --position--.

Column 9, line 13, change "constituted" to --constituting--.

Column 12, line 41 (claim 4, line 1) change "5" to --3--.

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*